US010337161B2

(12) United States Patent
Johansson et al.

(10) Patent No.: US 10,337,161 B2
(45) Date of Patent: Jul. 2, 2019

(54) METHOD AND AN APPARATUS FOR ATTENUATING PRESSURE PULSES

(71) Applicant: ABB Research Ltd., Zurich (CH)

(72) Inventors: Claes-Goran Johansson, Vasteras (SE); Petter Johansson, Gothenburg (SE); Thies Helbig, Berlin (DE)

(73) Assignee: ABB Research Ltd., Zurich (CH)

( * ) Notice: Subject to any disclaimer, the term of this patent is extended or adjusted under 35 U.S.C. 154(b) by 11 days.

(21) Appl. No.: 15/616,644

(22) Filed: Jun. 7, 2017

(65) Prior Publication Data

US 2017/0268195 A1 Sep. 21, 2017

Related U.S. Application Data

(63) Continuation of application No. 14/184,322, filed on Feb. 19, 2014, now Pat. No. 9,732,493, which is a continuation of application No. PCT/EP2011/064298, filed on Aug. 19, 2011.

(51) Int. Cl.

| | |
|---|---|
| ***E02D 7/02*** | (2006.01) |
| ***E02D 7/14*** | (2006.01) |
| ***E02D 7/06*** | (2006.01) |

(52) U.S. Cl.

CPC ..... *E02D 7/02* (2013.01); *E02D 7/06* (2013.01); *E02D 7/14* (2013.01)

(58) Field of Classification Search

CPC ..... E02D 7/02; E02D 7/06; E02D 7/14

See application file for complete search history.

(56) References Cited

U.S. PATENT DOCUMENTS 3,213,629 A * 10/1965 Manning ..... E02B 17/0008 405/225
3,224,204 A * 12/1965 Siebenhausen ..... E02B 17/027 166/358
3,353,362 A * 11/1967 Lubinski ..... E02D 7/06 173/1
4,479,550 A 10/1984 Kuhn et al.
6,567,341 B2 * 5/2003 Dreyer ..... B63G 13/02 181/296

(Continued)

FOREIGN PATENT DOCUMENTS

DE 102004043128 A1 3/2006
EP 2312060 A1 4/2011

(Continued)

OTHER PUBLICATIONS

International Search Report & Written Opinion of the International Searching Authority Application No. PCT/EP2011/064298 Completed: Oct. 14, 2011; dated Oct. 25, 2011 8 pages.

*Primary Examiner* — Tara Mayo-Pinnock

(74) *Attorney, Agent, or Firm* — Whitmyer IP Group LLC

(57) ABSTRACT

An apparatus and a method for attenuating water pressure pulses generated during sea piling when a percussion mechanism is used, including the stage of driving at least one pile into an earth by a percussion mechanism, while along at least a part of its axial extension, the pile is surrounded by water and at least partly by a tubular outer sleeve; and at least one gas-filled space is provided between the inner periphery of the outer sleeve and the outer periphery of the pile. The apparatus includes mechanisms for providing the gas-filled space.

22 Claims, 5 Drawing Sheets

(56) References Cited

U.S. PATENT DOCUMENTS

| | | | | |
|---|---|---|---|---|
| 2008/0006478 | A1 | 1/2008 | Dreyer | |
| 2012/0014753 | A1* | 1/2012 | Jung | E02D 13/00 405/227 |

FOREIGN PATENT DOCUMENTS

| | | | |
|---|---|---|---|
| GB | 2089407 | A | 6/1982 |
| WO | 2010151121 | A2 | 12/2010 |
| WO | 2011046430 | A1 | 4/2011 |

* cited by examiner

METHOD AND AN APPARATUS FOR ATTENUATING PRESSURE PULSES

FIELD OF THE INVENTION

The present invention relates to a method for attenuating water pressure pulses generated during sea piling when a percussion mechanism is used, the sea piling comprising the stage of driving at least one pile into an earth formation at the bottom of a sea or lake, the pile defining a longitudinal axis and having an outer periphery, by means of the percussion mechanism, while along at least a part of the axial extension of the pile the pile is surrounded by sea or lake water. Further, present invention relates to an apparatus for attenuation of water pressure pulses generated during sea piling when using a percussion mechanism for driving at least one pile into an earth formation at the bottom of a sea or lake, the pile defining a longitudinal axis and having an outer periphery, while along at least a part of the axial extension of the pile the pile is surrounded by sea or lake water. The present invention relates also relates to a sea piling system comprising an apparatus of the above-mentioned sort.

BACKGROUND OF THE INVENTION

When installing various structures or constructions out at sea or in lakes, e.g. bridges, oil platforms or windmills etc, which are to be supported by an earth formation, or earth formations, at the bottom of a sea or lake, the process of sea piling may be used. Sea piling involves driving one or a plurality of piles (columns), e.g. made of steel, into an earth formation at the bottom of the sea by. The piles are often in the form of large hollow pipes, preferably with a circular cross-section, having an outer diameter of about 1-3 meters. In general, piles having a longitudinal extension which exceeds the depth of the sea are used during sea piling. The piles may be driven into the earth formation by means of an impact or percussion mechanism, which may be designed in various ways. The percussion mechanism may comprise an anvil, which is connected at the top end of the pile, and an impact or piling hammer arranged to strike the anvil and thus drive the bottom end of the pile into the earth formation at the bottom of the sea. The piling hammer may be hydraulically or pneumatically driven, e.g., or driven by other means.

A large piling hammer may have a weight of less than 200 tons. When a pile has been positioned substantially vertically in the water and the piling hammer strikes the top of the pile to drive the pile into the bottom of the sea, a pressure pulse is created which propagates through the pile and radiates sound or a water pressure pulse into the water. Generated water pressure pulses propagate through the water in a radial direction away from the pile. A large piling hammer striking a pile may in the water cause peak pressure levels in the range of 180-210 dB and Sound Exposure Levels, SEL, in the range of 150-180 dB at a radial distance of 750 meters from the pile. SEL is by definition the single pulse energy level integrated over one second. Over the last years, SEL measured at a radial distance of 750 meters has become the most common value to define the highest acceptable sound level in water. It is believed that high level sound or water pressure pulses, e.g. generated during sea piling, may have a negative effect on marine life/animals. Thus, there is an incentive to keep the water sound or noise levels at an acceptable level and authorities have begun to set water sound limits which are not to be exceeded during sea piling. 160 dB at a 750 meter radius from the sea piling event is an example of a requirement level which is not to be exceeded during sea piling.

Small piles having a relatively small outer diameter, i.e. less than 1 meter, can be piled with SEL below 160 dB at 750 meters radius without any additional or auxiliary sound mitigation measures. In general, larger piles, with an outer diameter greater than 1 meter, which is used for windmills and industrial sea platforms, require larger piling hammer input energy and cannot be piled with SEL below 160 dB at 750 meters radius without applying additional or auxiliary sound mitigation measures.

Presently, there is a plurality of known mitigation methods or techniques for attenuating water pressure pulses generated during sea piling, to reduce the SEL. In the low attenuation region, i.e. below 4 dB, structural pile damping and accurate piling management of piling hammer input energy versus soil resistance are sufficient in most cases.

Greater attenuation, i.e. 4-8 dB, is in general attained by a plurality of free air bubbles moving freely and applied as an air curtain around the pile.

For yet greater attenuation, i.e. 8-12 dB, a further developed technique using air bubbles has been suggested, which uses multiple air bubbles with specific diameters and enclosed in thin plastic shells mounted at specific positions in a large net. The net is suggested to be applied around the pile and enclose the pile.

Prior art mitigation methods or techniques have limitations which only allow a maximum attenuation of less than 12-15 dB, but that maximum attenuation for the prior art techniques requires an accurate or optimal piling process control and the usage of the most sophisticated techniques known. If greater attenuation is required, there is no safe and robust prior art technique.

SUMMARY OF THE INVENTION

The inventors of the present invention have found that the technique using free air bubbles suffers from low attenuation reliability, as bubble size and bubble position is uncontrolled along the longitudinal extension of the pile. Further, the technique using free air bubbles has limitations in relation to sea water environment and is impaired by lateral movement of the sea water. Further, the inventors of the present invention have identified drawbacks with regard to the technique using air bubbles enclosed in thin plastic shells and a large net. The net may be bulky and the surroundings of sea piling site may hinder the net to completely enclose the pile. It is also complicated to manage a large net with thin air-filled shells when installing and removing the net, as the shells may be sensitive to mechanical stress. Thus, there is a need for a reliable and efficient attenuation of water pressure pulses generated during sea piling.

The object of the present invention is thus to improve the process of sea piling and to reduce the impact of sea piling on the surrounding marine environment.

Another object is to improve the attenuation of water pressure pulses generated during sea piling when a percussion mechanism is used.

The above-mentioned object of the present invention is attained by providing a method for attenuating water pressure pulses generated during sea piling when a percussion mechanism is used, the sea piling comprising the stage of driving at least one pile into an earth formation at the bottom of a sea or lake, the pile defining a longitudinal axis and having an outer periphery, by means of the percussion mechanism, while along at least a part of the axial extension of the pile the pile is surrounded by sea or lake water, wherein the method comprises the steps of surrounding the pile, along at least a section of said part of the axial extension of the pile, with a tubular outer sleeve having an inner periphery, the outer sleeve extending in the axial direction of the pile; and providing, at least partially along said section of said part of the axial extension of the pile, one gas-filled space or a plurality of gas-filled spaces between the inner periphery of the outer sleeve and the outer periphery of the pile.

By means of the method according to the present invention, the attenuation of water pressure pulses generated during sea piling, when a percussion mechanism is used, is efficiently improved. Attenuation between 20 and 30 dB, or possibly more, may be attained depending on the dimensions of the pile. The method of the present invention provides a less complicated and less complex attenuation procedure, which saves time and costs. By means of the method according to the present invention, the attenuating gas-filled space or spaces is/are efficiently introduced and maintained around the pile by means of the outer sleeve, and the gas-filled space or spaces provides/provide efficient attenuation of the water pressure pulses generated through the pile, and consequently, the sound or water pressure pulses generated by the sea piling are attenuated in an efficient manner. By means of the outer sleeve, the attenuating gas-filled space or spaces is/are not sensitive to lateral sea water movement, and the method thus provides reliable and robust attenuation, which does not require a bulky structure. Thus, by means of the method according to the present invention, the process of sea piling is improved and the impact on the surrounding marine environment is reduced.

Advantageously, the outer sleeve is placed in its operative position prior to placing the pile in its operative position within the outer sleeve. Alternatively, the pile may be placed in its operative position prior to placing the outer sleeve in its operative position outside of and around the pile. In the operative positions, the pile and the outer sleeve extend substantially vertically between the bottom of the sea and the region of the surface of the sea. The space or spaces may be filled with air or any other gas or gas mixture. The outer sleeve may be a hollow pipe or tube, e.g. made of steel, or any other suitable material. The sea piling may be performed at sea or in a lake. The outer sleeve may be positioned such that the outer sleeve and the pile are substantially coaxial. The outer sleeve may be formed by connecting or joining a plurality of sleeves.

According to an advantageous embodiment of the method according to the present invention, the step of surrounding the pile with a tubular outer sleeve comprises surrounding the pile, along substantially the entire axial extension of said part of the axial extension of the pile, with the tubular outer sleeve. By means of this embodiment, the attenuation is further improved, and a further improved process of sea piling is provided.

According to a further advantageous embodiment of the method according to the present invention, the step of surrounding the pile with a tubular outer sleeve comprises surrounding the pile, along at least the entire axial extension of said part of the axial extension of the pile, with the tubular outer sleeve. By means of this embodiment, the attenuation is further improved, and a further improved process of sea piling is provided.

According to another advantageous embodiment of the method according to the present invention, the step of providing one gas-filled space or a plurality of gas-filled spaces comprises providing, along substantially the entire axial extension of said section of said part of the axial extension of the pile, one gas-filled space or a plurality of gas-filled spaces between the inner periphery of the outer sleeve and the outer periphery of the pile. By means of this embodiment, the attenuation is further improved, and a further improved process of sea piling is provided.

According to yet another advantageous embodiment of the method according to the present invention, the step of providing one gas-filled space or a plurality of gas-filled spaces comprises providing, along at least the entire axial extension of said section of said part of the axial extension of the pile, one gas-filled space or a plurality of gas-filled spaces between the inner periphery of the outer sleeve and the outer periphery of the pile. By means of this embodiment, the attenuation is further improved, and a further improved process of sea piling is provided.

According to still another advantageous embodiment of the method according to the present invention, the step of providing one gas-filled space or a plurality of gas-filled spaces comprises providing, along substantially the entire axial extension of said part of the axial extension of the pile, one gas-filled space or a plurality of gas-filled spaces between the inner periphery of the outer sleeve and the outer periphery of the pile. By means of this embodiment, the attenuation is further improved, and a further improved process of sea piling is provided.

According to an advantageous embodiment of the method according to the present invention, the step of providing one gas-filled space or a plurality of gas-filled spaces comprises providing, along at least the entire axial extension of said part of the axial extension of the pile, one gas-filled space or a plurality of gas-filled spaces between the inner periphery of the outer sleeve and the outer periphery of the pile. By means of this embodiment, the attenuation is further improved, and a further improved process of sea piling is provided.

According to a further advantageous embodiment of the method according to the present invention, the step of providing one gas-filled space or a plurality of gas-filled spaces comprises providing one gas-filled space or a plurality of gas-filled compartments forming one gas-filled space between the inner periphery of the outer sleeve and the outer periphery of the pile. By means of this embodiment, the attenuation is further improved, and a further improved process of sea piling is provided.

According to another advantageous embodiment of the method according to the present invention, the step of providing one gas-filled space or a plurality of gas-filled spaces comprises providing one gas-filled space between the inner periphery of the outer sleeve and the outer periphery of the pile. By means of this embodiment, the attenuation is further improved, and a further improved process of sea piling is provided.

According to yet another advantageous embodiment of the method according to the present invention, the step of providing one gas-filled space or a plurality of gas-filled spaces comprises introducing gas, or a gas mixture, into one space or a plurality of spaces between the inner periphery of the outer sleeve and the outer periphery of the pile. By means of this embodiment, the gas-filled space or spaces are provided in an efficient manner. The gas, or gas mixture, may be introduced under pressure, i.e. as compressed gas. The gas, or gas mixture, may be introduced by means of a gas compressor. Advantageously, the gas, or gas mixture, may be introduced at the top end portion of the outer sleeve when the outer sleeve is provided around a pile standing substantially vertically. By way of the gas, or gas mixture, introduced, water present between the inner periphery of the outer sleeve and the outer periphery of the pile is pushed/pressed out of there. By means of this embodiment, the attenuation is further improved, and a further improved process of sea piling is provided.

According to still another advantageous embodiment of the method according to the present invention, the step of providing one gas-filled space or a plurality of gas-filled spaces comprises extracting water from one space or a plurality of spaces between the inner periphery of the outer sleeve and the outer periphery of the pile. By means of this embodiment, the gas-filled space/spaces is/are provided in an efficient manner. The water may be extracted by way of pumping, e.g. by means of a pump. The pump may be connected to the space or spaces at a lower portion of the outer sleeve when the outer sleeve is provided around a pile standing substantially vertically. By means of this embodiment, the attenuation is further improved, and a further improved process of sea piling is provided.

According to an advantageous embodiment of the method according to the present invention, the step of providing one gas-filled space or a plurality of gas-filled spaces comprises a combination of introducing gas, or a gas mixture, into one space or a plurality of spaces between the inner periphery of the outer sleeve and the outer periphery of the pile and extracting water from said space or said plurality of spaces. By means of this embodiment, the gas-filled space/spaces is/are provided in an efficient manner. By means of this embodiment, the attenuation is further improved, and a further improved process of sea piling is provided.

According to a further advantageous embodiment of the method according to the present invention, the method is characterized by detecting whether said space or said plurality of spaces is/are gas-filled, and by controlling the introduction of gas, or a gas mixture, and/or the extraction of water based at least partially on the detection whether said space or said plurality of spaces is/are gas-filled. By means of this embodiment, the gas-filled space/spaces is/are provided in an efficient manner. Said detection may be performed by way of one or a plurality of sensors in said space/spaces, or by way of one or a plurality of detectors located outside of the space/spaces, e.g. a hydrophone located in the water, e.g. at a radial distance of 750 meters. When using a pump for extracting water from the space or spaces, the detection may be performed by way of a sensor or sensors sensing the performance of the pump, e.g. power used by the pump, the rate of the pump, or the water flow through the pump etc. When the space/spaces is/are gas-filled and there is no more water to pump, the pump requires less power, or the rate of the pump will increase as the load on the pump decreases. By means of this embodiment, the attenuation is further improved, and a further improved process of sea piling is provided.

According to another advantageous embodiment of the method according to the present invention, the method comprises the step of preventing the outer sleeve from directly abutting against the pile by providing vibration isolating supports between the inner periphery of the outer sleeve and the outer periphery of the pile. A direction contact between the pile and the outer sleeve impairs the attenuation, and should be avoided. By means of this embodiment, the gas-filled space/spaces between the pile and the outer sleeve is/are efficiently assured and the attenuation is further improved, and a further improved process of sea piling is provided.

According to yet another advantageous embodiment of the method according to the present invention, a part of the outer sleeve is sunk into the earth formation at the bottom of the sea or lake. By means of this embodiment, a sealing at the bottom portion of the outer sleeve is provided. Having an outer sleeve adapted for depths of about 25-50 meters, the outer sleeve may, for example, sink about 4-5 meters into the earth formation, depending on the weight of the outer sleeve and the material of the earth formation.

According to still another advantageous embodiment of the method according to the present invention, the method is characterized by surrounding the pile, along at least a section of said part of the axial extension of the pile, with the outer sleeve such that the pile is axially movable in relation to the outer sleeve. By means of this embodiment, the attenuation is further improved, and a further improved process of sea piling is provided.

Further, the above-mentioned object of the present invention is attained by providing an apparatus for attenuation of water pressure pulses generated during sea piling when using a percussion mechanism for driving at least one pile into an earth formation at the bottom of a sea or lake, the pile defining a longitudinal axis and having an outer periphery, while along at least a part of the axial extension of the pile the pile is surrounded by sea or lake water, wherein the apparatus comprises a tubular outer sleeve having an inner periphery, wherein along at least a section of said part of the axial extension of the pile the outer sleeve is arranged to surround the pile, while extending in the axial direction of the pile, and wherein the apparatus comprises means for providing, at least partially along said section of said part of the axial extension of the pile, one gas-filled space or a plurality of gas-filled spaces between the inner periphery of the outer sleeve and the outer periphery of the pile.

By means of the apparatus according to the present invention, the attenuation of water pressure pulses generated during sea piling, when a percussion mechanism is used, is efficiently improved. Attenuation between 20 and 30 dB, or possibly more, may be attained depending on the dimensions of the pile. The apparatus of the present invention provides a less complicated and less complex attenuation procedure, which saves time and costs. By means of the apparatus according to the present invention, the attenuating gas-filled space or spaces is/are efficiently introduced and maintained around the pile by means of the outer sleeve, and the gas-filled space/spaces provides/provide efficient attenuation of the water pressure pulses generated from the pile, and consequently, the sound or water pressure pulses generated by the sea piling are attenuated in an efficient manner. By means of the apparatus according to the present invention, the attenuating gas-filled space/spaces is/are not sensitive to lateral sea water movement, and the apparatus thus provides reliable and robust attenuation. The inventive apparatus also has a non-bulky structure. Thus, by means of the apparatus according to the present invention, the process of sea piling is improved and the impact on the surrounding marine environment is reduced.

The space or spaces may be filled with air or any other gas or gas mixture. The outer sleeve may be a hollow pipe or tube, e.g. made of steel, or any other suitable material. The inner cross-section of the outer sleeve may be circular, but other shapes of the cross-section are also possible, e.g. oval or rectangular.

According to an advantageous embodiment of the apparatus according to the present invention, along substantially the entire axial extension of said part of the axial extension of the pile the outer sleeve is arranged to surround the pile.

By means of this embodiment, the attenuation is further improved, and a further improved process of sea piling is provided.

According to a further advantageous embodiment of the apparatus according to the present invention, along at least the entire axial extension of said part of the axial extension of the pile the outer sleeve is arranged to surround the pile. By means of this embodiment, the attenuation is further improved, and a further improved process of sea piling is provided.

According to another advantageous embodiment of the apparatus according to the present invention, along substantially the entire axial extension of said section of said part of the axial extension of the pile said means are arranged to provide one gas-filled space or a plurality of gas-filled spaces between the inner periphery of the outer sleeve and the outer periphery of the pile. By means of this embodiment, the attenuation is further improved, and a further improved process of sea piling is provided.

According to another advantageous embodiment of the apparatus according to the present invention, along at least the entire axial extension of said section of said part of the axial extension of the pile said means are arranged to provide one gas-filled space or a plurality of gas-filled spaces between the inner periphery of the outer sleeve and the outer periphery of the pile. By means of this embodiment, the attenuation is further improved, and a further improved process of sea piling is provided.

According to yet another advantageous embodiment of the apparatus according to the present invention, along substantially the entire axial extension of said part of the axial extension of the pile said means are arranged to provide one gas-filled space or a plurality of gas-filled spaces between the inner periphery of the outer sleeve and the outer periphery of the pile. By means of this embodiment, the attenuation is further improved, and a further improved process of sea piling is provided.

According to still another advantageous embodiment of the apparatus according to the present invention, along at least the entire axial extension of said part of the axial extension of the pile said means are arranged to provide one gas-filled space or a plurality of gas-filled spaces between the inner periphery of the outer sleeve and the outer periphery of the pile. By means of this embodiment, the attenuation is further improved, and a further improved process of sea piling is provided.

According to an advantageous embodiment of the apparatus according to the present invention, said means are arranged to provide one gas-filled space or a plurality of gas-filled compartments forming one gas-filled space between the inner periphery of the outer sleeve and the outer periphery of the pile. By means of this embodiment, the attenuation is further improved, and a further improved process of sea piling is provided.

According to a further advantageous embodiment of the apparatus according to the present invention, said means are arranged to provide one gas-filled space between the inner periphery of the outer sleeve and the outer periphery of the pile. By means of this embodiment, the attenuation is further improved, and a further improved process of sea piling is provided.

According to another advantageous embodiment of the apparatus according to the present invention, said means comprise gas introduction means for introducing gas, or a gas mixture, into one space or a plurality of spaces between the inner periphery of the outer sleeve and the outer periphery of the pile. By means of this embodiment, the gas-filled space/spaces is/are provided in an efficient manner. The gas introduction means may comprise means for introducing gas, or a gas mixture, under pressure, i.e. as compressed gas, e.g. a gas compressor. The apparatus may comprise at least one inlet connected to the space/spaces and to which the gas introduction means is connectable. The outer sleeve may define a longitudinal axis and may have a first end portion and a second end portion, the longitudinal axis extending through the first and second end portions. When the outer sleeve is in its operative position, the first end portion is the top end portion and the second end portion is the bottom end portion. The first end portion of the outer sleeve may be provided with said inlet. The apparatus may comprise at least one outlet connected to the space or spaces. The second end portion of the outer sleeve may be provided with said outlet. The gas introduction means may be arranged to press/push out water present between the inner periphery of the outer sleeve and the outer periphery of the pile through the outlet, and e.g. into the water. By means of this embodiment, the attenuation is further improved, and a further improved process of sea piling is provided. The gas introduction means may be arranged to maintain at least one pressure in the space/spaces.

According to yet another advantageous embodiment of the apparatus according to the present invention, said means comprise water extraction means for extracting water from one space or a plurality of spaces between the inner periphery of the outer sleeve and the outer periphery of the pile. By means of this embodiment, the gas-filled space/spaces is/are provided in an efficient manner. By means of this embodiment, the attenuation is further improved, and a further improved process of sea piling is provided.

According to still another advantageous embodiment of the apparatus according to the present invention, the water extraction means comprise a water pump. The water pump may be connectable to said outlet. By means of this embodiment, the attenuation is further improved, and a further improved process of sea piling is provided.

According to an advantageous embodiment of the apparatus according to the present invention, the outer sleeve has an outer periphery, the water extraction means comprise a tubular second outer sleeve having an inner periphery, partially along said section of said part of the axial extension of the pile the second outer sleeve surrounds the outer sleeve, a room is formed between the outer periphery of the outer sleeve and the inner periphery of the second outer sleeve, the room and the space or the plurality of spaces being in communication with one another, and the water pump is arranged to extract water from the room in order to extract water from the space or the plurality of spaces. By means of this embodiment, the water pump is installed in an efficient way, and the pump may be prevented from sinking into the earth formation at the bottom of the sea when the outer sleeve sinks down into the earth formation. By means of this embodiment, the attenuation is further improved, and a further improved process of sea piling is provided.

According to a further advantageous embodiment of the apparatus according to the present invention, the apparatus comprises at least one detector for detecting whether said space or said plurality of spaces is/are gas-filled, and a control unit arranged to control the gas introduction means and/or the water extraction means based at least partially on the detection of the at least one detector, for controlling the introduction of gas, or a gas mixture, and/or the extraction of water. By means of this embodiment, the gas-filled space/spaces is/are provided in an efficient manner. The least one detector may comprise one or a plurality of sensors within said space or spaces, or one or a plurality of detectors located outside of the space or spaces, e.g. a hydrophone located in the water. When using a pump for extracting water from the space or spaces, the least one detector may comprise a sensor or sensors sensing the performance of the pump, e.g. power used by the pump, the rate of the pump, or the water flow through the pump etc. When the space or spaces is/are gas-filled and there is no more water to pump, the pump requires less power, or the rate of the pump will increase as the load on the pump decreases. By means of this embodiment, the attenuation is further improved, and a further improved process of sea piling is provided. A hydrophone may sense the sound pressure pulses from the sea piling, and when a decrease of the level of the sound pressure pulses is sensed by the hydrophone, it may be determined that the space/spaces has/have been gas-filled, and that a resulting attenuation is provided. The control unit may comprise a CPU, or computer means. The control unit may be connected to the at least one detector and to the gas introduction means and/or the water extraction means.

According to another advantageous embodiment of the apparatus according to the present invention, the apparatus comprises vibration isolating supports between the inner periphery of the outer sleeve and the outer periphery of the pile to prevent the outer sleeve from directly abutting against the pile. A direction contact between the pile and the outer sleeve impairs the attenuation, and should be avoided. By means of this embodiment, the attenuation is further improved, and a further improved process of sea piling is provided. Examples of vibration isolating supports are disclosed in the detailed description of preferred embodiments. Further, the vibration isolating supports facilitate to keep the pile and the outer sleeve substantially coaxial.

According to yet another advantageous embodiment of the apparatus according to the present invention, along at least a section of said part of the axial extension of the pile the outer sleeve is arranged to surround the pile such that the pile is axially movable in relation to the outer sleeve. By means of this embodiment, the attenuation is further improved, and a further improved process of sea piling is provided.

The above-mentioned object of the present invention is also attained by a sea piling system comprising a percussion mechanism for driving at least one pile into an earth formation at the bottom of a sea or lake while along at least a part of the axial extension of the pile the pile is surrounded by sea or lake water, wherein the system comprises at least one apparatus according to the present invention. By means of the sea piling system according to the present invention, an improved sea piling system is provided for reasons stated above in connection with the disclosure of the apparatus according to the present invention and the various embodiments of the apparatus. The sea piling may be performed at sea or in a lake.

The method, apparatus and system of the present invention may be used at depths (depth of the sea) of about 20-60 meters. The method, apparatus and system of the present invention may also be used at other depths.

The above-mentioned features and embodiments of the method, apparatus and system, respectively, may be combined in various possible ways providing further advantageous embodiments.

Further advantageous embodiments of the method, apparatus and system, respectively, according to the present invention and further advantages with the present invention emerge from the detailed description of embodiments.

BRIEF DESCRIPTION OF THE DRAWINGS

The present invention will now be described, for exemplary purposes, in more detail by way of embodiments and with reference to the enclosed drawings, in which.

DETAILED DESCRIPTION OF THE INVENTION

Figure 1:
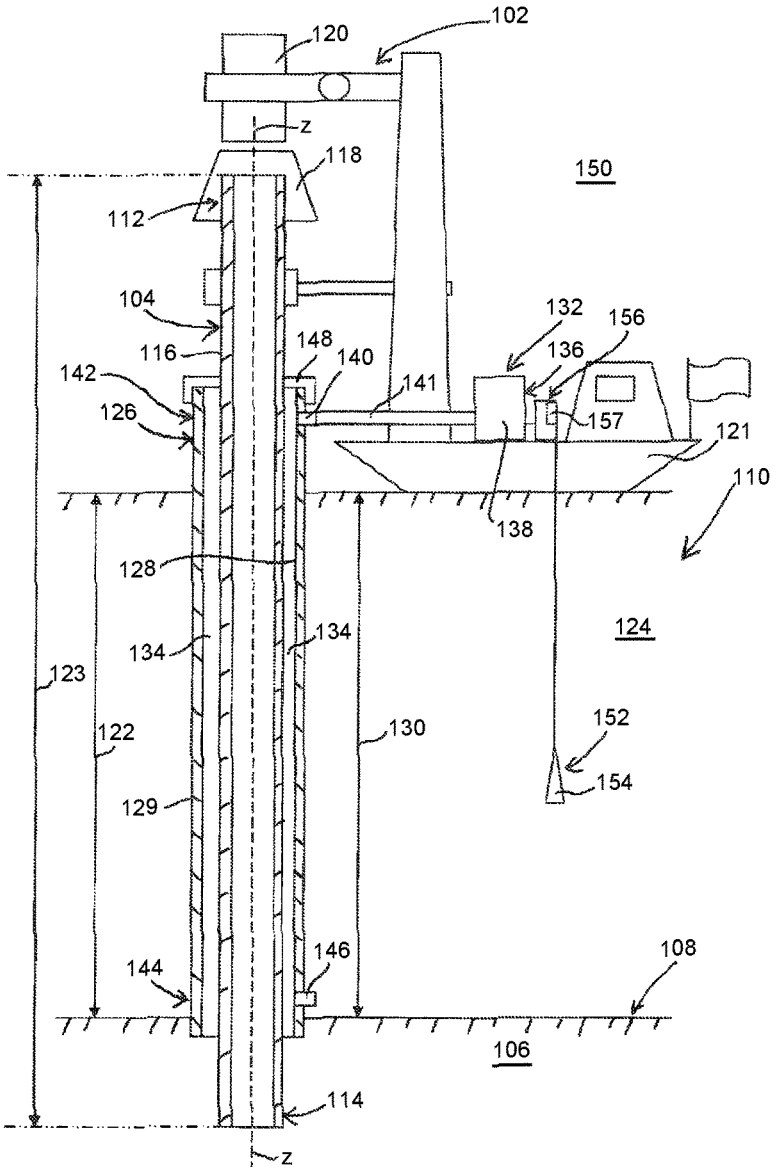
FIG. 1 is a schematic sectional side view of a first embodiment of the apparatus according to the present invention, applied to a sea piling system and a pile.

FIG. 1 schematically shows a first embodiment of the apparatus according to the present invention, applied to a pile. Further, FIG. 1 schematically illustrates aspects of a first embodiment of the sea piling system according to the present invention, comprising the first embodiment of the apparatus. The sea piling system comprises a percussion mechanism 102 for driving at least one pile 104 into an earth formation 106 at the bottom 108 of a sea or lake 110. The pile 104 has a top end 112 and a bottom end 114 and defines a longitudinal axis z-z extending through the top and bottom ends 112, 114 of the pile 104. The pile 104 has an outer periphery 116 and may have a circular cross-section. The pile 104 may be tubular and hollow and may be made of steel, or any other suitable material. The percussion mechanism 102 may comprise an anvil 118, which is connectable at the top end 112 of the pile 104, and an impact or piling hammer 120 arranged to strike the anvil 118 and thus drive the bottom end 114 of the pile 104 into the earth formation 106 at the bottom 108 of the sea 110. The piling hammer 120 may be hydraulically or pneumatically driven, e.g., or driven by other means. Before driving the pile 104 into the earth formation 106, the pile 104 is in general positioned to extend in a substantially vertical direction.

The percussion mechanism 102 and additional equipment to position the pile 104 in an operative position ready to be driven into the earth formation 106 may have various designs known to the person skilled in the art, and may be mounted to a platform, e.g. a floating platform, such as a vessel 121, known to the skilled person, and are thus not discussed in more detail.

In sea piling sequences of 3000-6000 strikes per pile, radial pile tension caused by the axial impacts of the piling hammer is the sound source origin of each strike. Radiated sound spectrum is shaped by the impact force spectrum, pile resonances and the pile radiation efficiency. Maximum sound energy may occur, in the frequency range, between 70 and 300 Hz. Radial pile surface velocity vibrates in phase along the pile 104 and resonance amplification from the pile breathing mode, also called tension mode, ring mode or zero mode, must be considered. The pile breathing mode is when the pile 104, or the circumference of the pile 104, expands outwardly in a radial direction due to the strike of the piling hammer 120 and subsequently contracts inwardly in a radial direction.

The apparatus according to the present invention is arranged to attenuate water pressure pulses generated during sea piling when using the percussion mechanism 102 for driving at least one pile 104 into the earth formation 106 while along at least a part 122 of the axial extension 123 of the pile 104 the pile 104 is surrounded by sea or lake water 124. The apparatus comprises a tubular outer sleeve 126 having an inner periphery 128. The outer sleeve 126 may be a hollow pipe or tube, e.g. made of steel, or of any other suitable material. Along at least a section 130 of said part 122 of the axial extension 123 of the pile 104 the outer sleeve 126 is arranged to surround the pile 104, while extending in the axial direction of the pile 104. The outer sleeve 126 defines a longitudinal axis z-z, and the outer sleeve 126 may be positioned such that the outer sleeve 126 and the pile 104 are substantially coaxial. Advantageously, along at least a section 130 of said part 122 of the axial extension 123 of the pile 104 the outer sleeve 126 is arranged to surround the pile 104 such that the pile 104 is axially movable in relation to the outer sleeve 104. The apparatus comprises means 132 for providing, at least partially along said section 130 of said part 122 of the axial extension 123 of the pile 104, one gas-filled space 134 or a plurality of gas-filled spaces 134 between the inner periphery 128 of the outer sleeve 126 and the outer periphery 116 of the pile 104. By means of said gas-filled space/spaces 134, an efficient attenuation of water pressure pulses generated during sea piling, when a percussion mechanism is used, is provided. Said means 132 may comprise gas introduction means 136 for introducing gas, or a gas mixture, into one space 134 or a plurality of spaces 134 between the inner periphery 128 of the outer sleeve 126 and the outer periphery 116 of the pile 104. The gas introduction means 136 may comprise means for introducing gas, or a gas mixture, under pressure, i.e. as compressed gas, e.g. a gas compressor 138. The gas, or the gas mixture, introduced may be a single gas or a gas mixture, e.g. air. The apparatus may comprise at least one inlet 140 connected, directly or indirectly, to the space 134 or spaces 134 and to which the gas introduction means 136 is connectable, e.g. via a conduit 141, such as a pipe or tube. The gas introduction means 136 may be arranged to maintain at least one pressure in the space/spaces 134. The outer sleeve 126 and may have a first end portion 142 and a second end portion 144, and the longitudinal axis z-z of the outer sleeve 126 may extend through the first and second end portions 142, 144. When the outer sleeve 126 is in its operative position, the first end portion 142 is the top end portion and the second end portion 144 is the bottom end portion. The first end portion 142 of the outer sleeve 126 may be provided with said inlet 140. The apparatus may comprise at least one outlet 146 connected, directly or indirectly, to the space/spaces 134. The second end portion 144 of the outer sleeve 126 may be provided with said outlet 146. The gas introduction means 136 may be arranged to press out water present between the inner periphery 128 of the outer sleeve 126 and the outer periphery 116 of the pile 104 through the outlet 146, and e.g. into the sea 110. Said means 132 may comprise a sealing element 148 provided at the first end portion 142 of the outer sleeve 126 to seal between the outer sleeve and the pile 104 for sealing off the space/spaces 134 from the atmosphere 150 outside of the outer sleeve 126.

With reference to FIG. 1, along at least the entire axial extension of said part 122 of the axial extension 123 of the pile 104 the outer sleeve 126 may be arranged to surround the pile. Along substantially the entire, or along at least the entire, axial extension of said part 122 of the axial extension 123 of the pile 104 said means 132 may be arranged to provide one gas-filled space 134 or a plurality of gas-filled spaces 134 between the inner periphery 128 of the outer sleeve 126 and the outer periphery 116 of the pile 104. Alternatively, the outer sleeve 126 may be arranged to surround the pile along a section of said part 122 of the axial extension 123 of the pile 104, where the section is axially shorter than said part 122. Alternatively, the said means 132 may be arranged to provide one gas-filled space 134 or a plurality of gas-filled spaces 134 between the inner periphery 128 of the outer sleeve 126 and the outer periphery 116 of the pile 104 along, or at least partially along, a section of said part 122 of the axial extension 123 of the pile 104, where the section is axially shorter than said part 122.

The apparatus may comprise at least one detector 152 for detecting whether said space/spaces 134 is/are gas-filled. The at least one detector 152 may comprise a hydrophone 154 arranged to sense the sound pressure pulses from the sea piling. When a decrease of the level of the sound pressure pulses is sensed by the hydrophone 154, it can be determined that the space/spaces 134 has/have been gas-filled and that the inventive attenuation is provided. Other detectors, as mentioned above, are also possible. The apparatus may comprise a control unit 156 arranged to control the gas introduction means 136 based at least partially on the detection of the at least one detector 152, for controlling the introduction of gas, or a gas mixture, into the space/spaces 134. The control unit 156 may comprise a CPU 157. The control unit 154 may be connected to the at least one detector 152 and to the gas introduction means 136.

Figure 2:
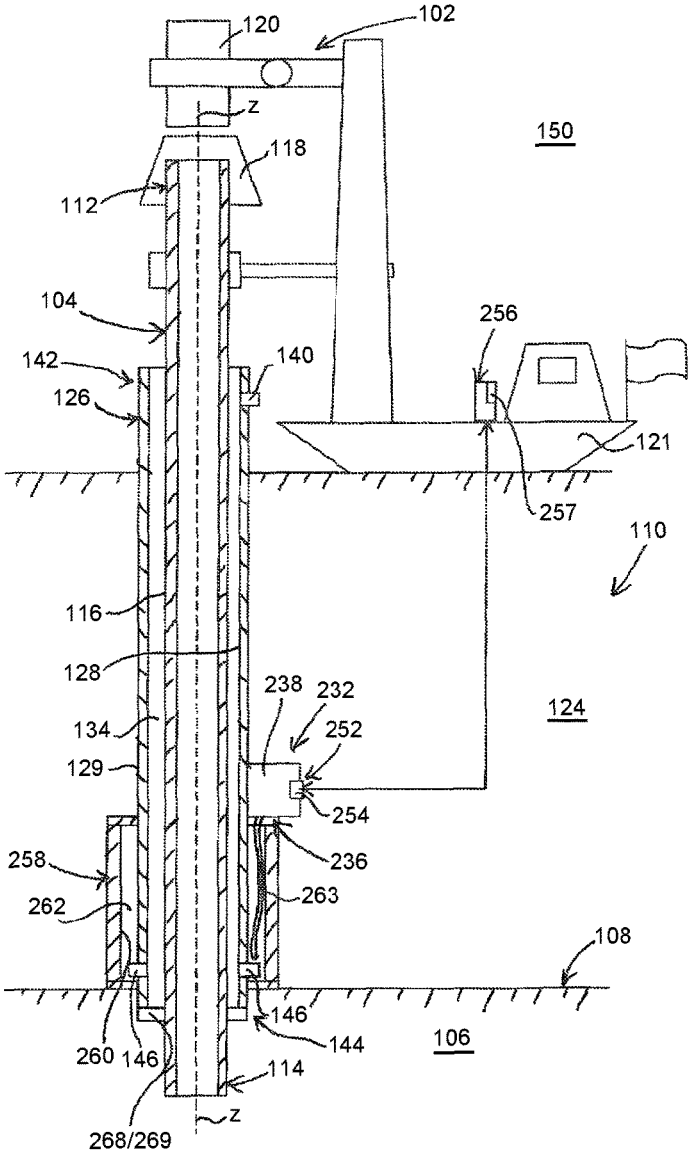
FIG. 2 is a schematic sectional side view of a second embodiment of the apparatus according to the present invention, applied to a sea piling system and a pile.

FIG. 2 schematically shows a second embodiment of the apparatus according to the present invention, applied to a pile 104. Further, FIG. 2 schematically illustrates aspects of a second embodiment of the sea piling system according to the present invention, comprising the second embodiment of the apparatus. In the second embodiment of the apparatus, the means 232 for providing one gas-filled space 134 or a plurality of gas-filled spaces 134 between the inner periphery 128 of the outer sleeve 126 and the outer periphery 116 of the pile 104 comprise water extraction means 236 for extracting water from one space 134 or a plurality of spaces 134 between the inner periphery 128 of the outer sleeve 126 and the outer periphery 116 of the pile 104. The water extraction means 236 comprise a water pump 238. The outer sleeve 126 has an outer periphery 129. The water extraction means 236 may comprise a tubular second outer sleeve 258 having an inner periphery 260. Partially along said section 130 of said part 122 of the axial extension 123 of the pile 104 the second outer sleeve 258 surrounds the outer sleeve 126, and the second outer sleeve 258 may be closed at the top and at the bottom. The second outer sleeve 258 may be mounted adjacent to the region of the second end portion 144 of the outer sleeve 126. A room 262 is formed between the outer periphery 129 of the outer sleeve 128 and the inner periphery 260 of the second outer sleeve 258, and the room 262 and the space/spaces 134 is/are in communication with one another. The water pump 238 may be arranged to extract water from the room 262 in order to extract water from the space/spaces 134. The water extraction means 236 may comprise a suction tube 263 connected to the water pump 238 and at least partially provided in the room 262. Alternatively, the water pump 238 may be connected to the outer sleeve 126 without the second outer sleeve 258. The second embodiment of the apparatus may comprise at least one detector 252 for detecting whether said space/spaces 134 is/are gas-filled, and a control unit 256, e.g. including a CPU 257, arranged to control the water extraction means 236 based at least partially on the detection of the at least one detector 252, for controlling the extraction of water from the space/spaces 134. The at least one detector 252 may comprise at least one sensor 254 for sensing the performance of the water pump 238, e.g. power used by the water pump 238, the rate of the water pump 238, or the water flow through the water pump 238. When the space/spaces is/are gas-filled and there is no more water to pump, the water pump requires less power, or the rate of the pump will increase as the load on the water pump decreases. At the second end portion 144, the outer sleeve 126 may be provided with a sealing unit 268 or filter unit 269 for preventing earth formation material, e.g. sand, water or a mixture thereof from entering the space/spaces 134 between the inner periphery 128 of the outer sleeve 126 and the outer periphery 116 of the pile 104.

Figure 3:
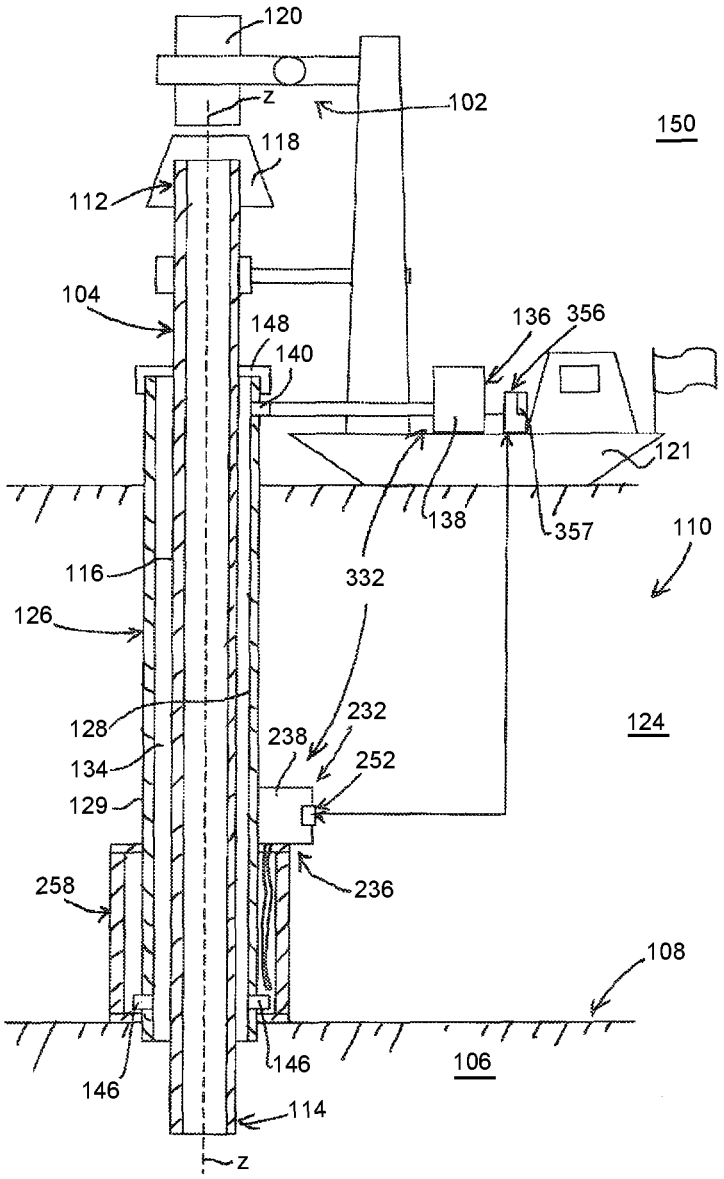
FIG. 3 is a schematic sectional side view of a third embodiment of the apparatus according to the present invention, applied to a sea piling system and a pile.

FIG. 3 schematically shows a third embodiment of the apparatus according to the present invention, applied to a pile 104. Further, FIG. 3 schematically illustrates aspects of a third embodiment of the sea piling system according to the present invention, comprising the third embodiment of the apparatus. The third embodiment is a combination of the first and second embodiments of the apparatus according to the present invention, as disclosed above. Thus, in the third embodiment of the apparatus, the means 332 for providing one gas-filled space 134 or a plurality of gas-filled spaces 134 between the inner periphery 128 of the outer sleeve 126 and the outer periphery 116 of the pile 104 comprise both the gas introduction means 136 as disclosed in connection with FIG. 1 and the water extraction means 236 as disclosed in connection with FIG. 2. Both the gas introduction means 136 and the water extraction means 236 may be used at the same time. Alternatively, by means of this embodiment, one of the gas introduction means 136 and the water extraction means 236 may be used, while the other may be inactive and only used as a backup upon failure. The third embodiment of the apparatus may comprise at least one detector 252 corresponding to the detector disclosed above in connection with FIG. 2. The third embodiment of the apparatus may comprise a control unit 356, e.g. including a CPU 357, arranged to control the gas introduction means 136 and the water extraction means 236 based at least partially on the detection of the at least one detector 252, for controlling the introduction of gas, or a gas mixture, and the extraction of water.

Figure 4:
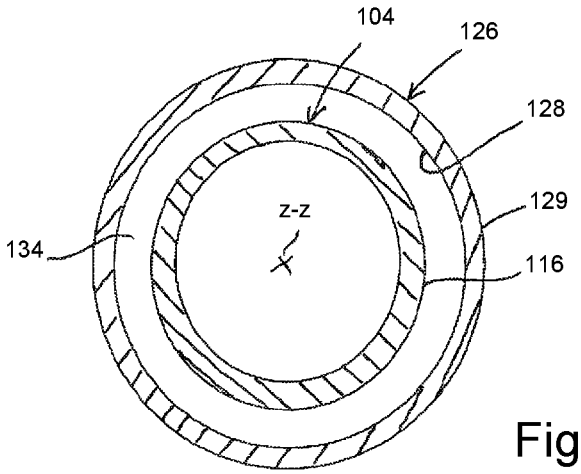
FIG. 4 is a schematic sectional top view of the first embodiment of FIG. 1.

FIG. 4 is a schematic sectional top view of the first embodiment of FIG. 1, showing the pile 104, the outer sleeve 126 surrounding the pile 104 and the gas-filled space 134 formed between the inner periphery 128 of the outer sleeve 126 and the outer periphery 116 of the pile 104. Although the cross-sections of the pile 104 and outer sleeve 126 are circular, other shapes of each cross-section is possible. When a pile 104 having an outer diameter of 2.5 meters is used, the inner diameter of the outer sleeve 126 may be 2.6 meters, which results in a radial spacing of about 5 cm between the inner periphery 128 of the outer sleeve 126 and the outer periphery 116 of the pile 104, if the pile 104 and the outer sleeve 126 are substantially coaxial. However, other dimensions are possible.

Figure 5:
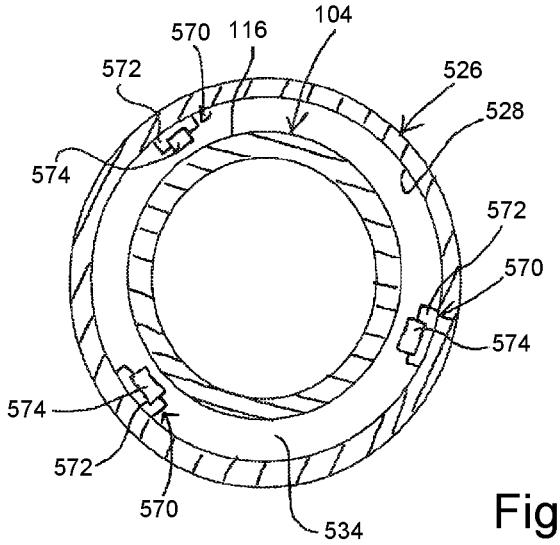
FIG. 5 is a schematic sectional top view of a fourth embodiment of the apparatus according to the present invention, applied to a pile.

FIG. 5 is a schematic sectional top view of a fourth embodiment of the apparatus according to the present invention, applied to a pile 104. The fourth embodiment may essentially correspond to the first, second or third embodiment as disclosed above, or mixtures thereof, but is in addition provided with vibration isolating supports 570 between the inner periphery 528 of the outer sleeve 526 and the outer periphery 116 of the pile 104, to prevent the inner periphery 528 of the outer sleeve 526, and thus the outer sleeve 526, from directly abutting against the pile 104, and to maintain the gas-filled space/spaces 534. The vibration isolating supports 570 may also facilitate to keep the pile 104 and the outer sleeve 526 substantially coaxial. The vibration isolating supports 570 may comprise three vibration isolating supports 570 distributed around the inner periphery 528 of the outer sleeve 526. Each vibration isolating support 570 may comprise a holder 572 attached to the inner periphery 528 of the outer sleeve 526 and extending axially at least partially along the axial extension of the outer sleeve 526. Each holder 572 may hold a guide 574. The guide 574 may be made of a material of negligible or low stiffness, e.g. a suitable polymer, so that vibrations are not propagated through the guide 574. By means of vibration isolating supports 570, the gas-filled space 534 between the pile 104 and the outer sleeve 526 is efficiently assured. Each vibration isolating support 570 may extend along substantially the entire axial extension of the outer sleeve 526. Alternatively, the vibration isolating supports may be attached to the pile 104. Other designs of the vibration isolating supports 570 are possible.

Figure 6:
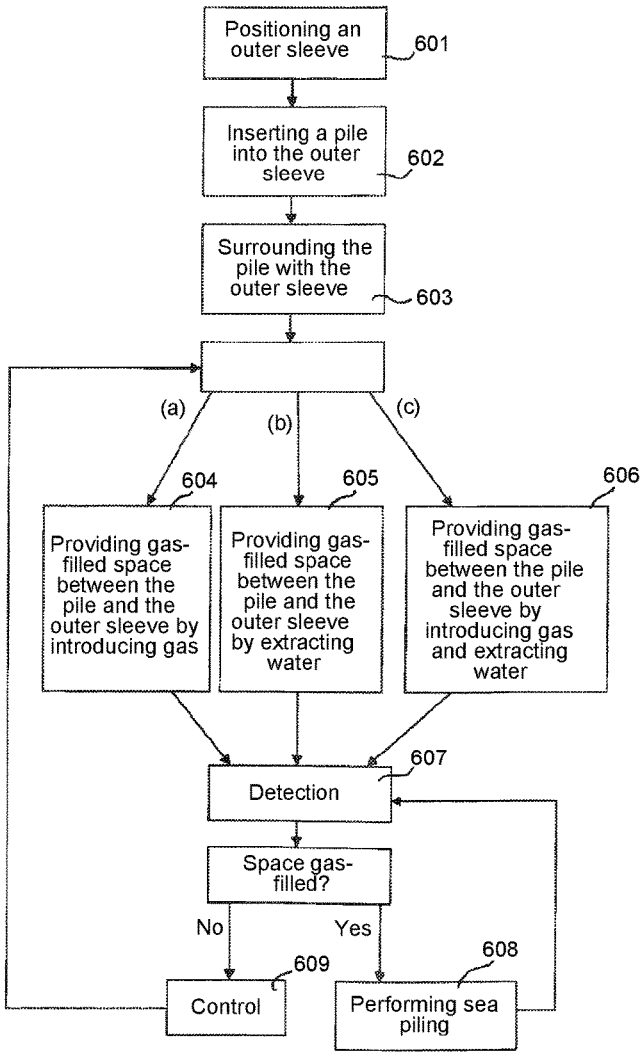
FIG. 6 is a flow chart illustrating aspects of the method according to the present invention.

With reference to FIG. 6, a flow chart is shown illustrating aspects of the method according to the present invention, for attenuating water pressure pulses generated during sea piling when a percussion mechanism is used. The sea piling comprises the stage of driving at least one pile 104, e.g. as disclosed above, into an earth formation 106 at the bottom of a sea or lake, by means of the percussion mechanism, while along at least a part of the axial extension of the pile the pile is surrounded by sea or lake water. First, a tubular outer sleeve, as disclosed in connection with FIGS. 1-5, is positioned substantially vertically in the sea or the lake and a part of the outer sleeve is sunk into the earth formation, at step 601. The pile 104 is inserted into the outer sleeve from above, so that the pile 104 also extends substantially vertically, at step 602. The outer sleeve then extends in the axial direction of the pile. The pile, along at least a section of said part of the axial extension of the pile is surrounded with the tubular outer sleeve such that the pile is axially movable in relation to the outer sleeve, at step 603, the outer sleeve extending in the axial direction of the pile. Alternatively, the pile may first be positioned in its substantially vertical operative position, and subsequently the outer sleeve may be put around the pile. When the pile and outer sleeve are in place, sea water may initially be present between them. At least partially along said section of said part of the axial extension of the pile, one gas-filled space or a plurality of gas-filled spaces between the inner periphery of the outer sleeve and the outer periphery of the pile is/are provided by:

(a) introducing gas, or a gas mixture, into one space or a plurality of spaces between the inner periphery of the outer sleeve and the outer periphery of the pile, at step 604, or (b) extracting water from one space or a plurality of spaces between the inner periphery of the outer sleeve and the outer periphery of the pile, at step 605, or (c) both introducing gas, or a gas mixture, into one space or a plurality of spaces between the inner periphery of the outer sleeve and the outer periphery of the pile and extracting water from said space or said plurality of spaces, at step 606. The gas introduced may be a single gas or a gas mixture, e.g. air, and the gas may be introduced under pressure.

Whether said space or said plurality of spaces is/are gas-filled is detected, at step 607. If it is detected that said space/spaces is/are gas-filled, the sea piling may be performed with a sufficient attenuation, at step 608, including the stage of driving the pile into the earth formation. If it is detected that said space/spaces is/are not gas-filled, the introduction of gas, or a gas mixture, and/or the extraction of water are/is controlled, at step 609, by way of any of the above-mentioned steps 604-606, based at least partially on said detection. Said detection may be performed by way of at least one sensor in said space/spaces, or by way of a hydrophone located in the water outside the outer sleeve, e.g. at a radial distance of 750 meters. When using a pump for extracting water from the space or spaces, the detection may be performed by way of at least one sensor sensing the performance of the pump, e.g. power used by the pump, the rate of the pump, or the water flow through the pump etc. The method may comprise the step of preventing the outer sleeve from directly abutting against the pile by providing vibration isolating supports, e.g. disclosed in FIG. 5, between the inner periphery of the outer sleeve and the outer periphery of the pile.

Although the above-mentioned pile 104 is disclosed as a hollow tubular element, the pile may also be solid.

The invention shall not be considered limited to the embodiments illustrated, but can be modified and altered in many ways by one skilled in the art, without departing from the scope of the appended claims.

What is claimed is:

1. A method for attenuating water pressure pulses generated during sea piling when a percussion mechanism is used, the sea piling comprising a stage of driving at least one pile into an earth formation at the bottom of a sea or lake by means of the percussion mechanism, the pile having an axial extension defining a longitudinal axis and having an outer periphery, at least a part of the axial extension of the pile is surrounded by sea or lake water, the method comprising the steps of:

surrounding the pile, along at least a section of said part of the axial extension, with a tubular outer sleeve, the outer sleeve having an inner periphery and extending in an axial direction of the pile; and using a gas introduction system to provide, at least partially along said section of said part of the axial extension, one gas-filled space or a plurality of gas-filled spaces between the inner periphery of the outer sleeve and the outer periphery of the pile; and maintaining a pressure in said gas-filled space or said plurality of gas-filled spaces via said gas introduction system.

2. The method according to claim 1, wherein the step of surrounding the pile with a tubular outer sleeve comprises surrounding the pile, along an entirety of said part of the axial extension of the pile, with the tubular outer sleeve.

3. The method according to claim 2, wherein the step of using a gas introduction system to provide one gas-filled space or a plurality of gas-filled spaces comprises providing, along the entirety of said part of the axial extension of the pile, one gas-filled space or a plurality of gas-filled spaces between the inner periphery of the outer sleeve and the outer periphery of the pile.

4. The method according to claim 1, wherein the step of using a gas introduction system to provide one gas-filled space or a plurality of gas-filled spaces comprises providing, along an entirety of said section of said part of the axial extension, one gas-filled space or a plurality of gas-filled spaces between the inner periphery of the outer sleeve and the outer periphery of the pile.

5. The method according to claim 1, wherein the step of using a gas introduction system to provide one gas-filled space or a plurality of gas-filled spaces comprises introducing gas, or a gas mixture, into one space or a plurality of spaces between the inner periphery of the outer sleeve and the outer periphery of the pile.

6. The method according to claim 5, further comprising the steps of:

detecting whether said space or said plurality of spaces is/are gas-filled, and controlling the introduction of gas, or a gas mixture, and/or extraction of water from said space or said plurality of spaces, said controlling being based at least partially on the detection of whether said space or said plurality of spaces is/are gas-filled.

7. The method according to claim 6, wherein the step of detecting comprises using one or more sensors, at least one of said one or more sensors obtaining performance data of a water extraction unit.

8. The method according to claim 1, further comprising the step of surrounding the pile, along at least said section of said part of the axial extension, with the outer sleeve such that the pile is axially movable in relation to the outer sleeve.

9. The method according to claim 1, wherein the step of providing one gas-filled space or a plurality of gas-filled spaces comprises providing one gas-filled space of a plurality of gas-filled spaces via an inlet that extends through a wall of the outer sleeve.

10. The method according to claim 1, further comprising the step of removing water present between the inner periphery of the outer sleeve and the outer periphery of the pile through an outlet, said outlet extending through a wall of the outer sleeve.

11. The method according to claim 1, wherein the outer sleeve has a first end and a second end opposite the first end, the second end being configured for positioning proximate to the earth formation at the bottom of the sea or lake; and wherein the method further comprises the step of sealing the first end of the outer sleeve with the pile so that the one gas-filled space or the plurality of gas-filled spaces are isolated from outside of the outer sleeve, said step of sealing the first end includes sinking a part of the outer sleeve into the earth formation.

12. The method according to claim 1, wherein the outer sleeve has a first end and a second end opposite the first end, the second end being configured for positioning proximate to the earth formation at the bottom of the sea or lake; and wherein the method further comprises the step of providing a sealing element at the second end to seal the outer sleeve with the pile.

13. The method according to claim 1, wherein the outer sleeve has a first end and a second end opposite the first end, the second end being configured for positioning proximate to the earth formation at the bottom of the sea or lake; and wherein the method further comprises the step of providing a filter unit at the second end to at least minimize earth formation material from entering between the inner periphery of the outer sleeve and the outer periphery of the pile.

14. The method according to claim 1, further comprising the step of sinking a portion of the outer sleeve into the earth formation at the bottom of the sea or lake.

15. An apparatus for attenuation of water pressure pulses generated during sea piling when using a percussion mechanism for driving at least one pile into an earth formation at the bottom of a sea or lake, the pile having an axial extension defining a longitudinal axis and having an outer periphery, at least a part of the axial extension is surrounded by sea or lake water, the apparatus comprising:

a tubular outer sleeve having an inner periphery, the outer sleeve being configured to surround the pile along at least a section of said part of the axial extension while extending in an axial direction of the pile, and a gas introduction system to providing at least partially along said section of said part of the axial extension, one gas-filled space or a plurality of gas-filled spaces between the inner periphery of the outer sleeve and the outer periphery of the pile, said gas introduction system being configured to maintain a pressure in said gas-filled space or said plurality of gas-filled spaces.

16. The apparatus according to claim 15, wherein the outer sleeve is configured to surround the pile along an entirety of said part of the axial extension.

17. The apparatus according to claim 16, wherein said gas introduction system is configured to provide one gas-filled space or a plurality of gas-filled spaces between the inner periphery of the outer sleeve and the outer periphery of the pile along the entirety of said part of the axial extension.

18. The apparatus according to claim 15, wherein said gas introduction system comprises a gas compressor for introducing gas, or a gas mixture, into one space or a plurality of spaces between the inner periphery of the outer sleeve and the outer periphery of the pile.

19. The apparatus according to claim 18, wherein the apparatus comprises at least one detector for detecting whether said space or said plurality of spaces is/are gas-filled, and a control unit configured to control the gas introduction system and/or a water extraction system based at least partially on the detection of the at least one detector, for controlling the introduction of gas, or a gas mixture, and/or the extraction of water.

20. The apparatus according to claim 15, wherein the apparatus comprises vibration isolating supports between the inner periphery of the outer sleeve and the outer periphery of the pile to prevent the outer sleeve from directly abutting against the pile.

21. The apparatus according to claim 15, wherein along at least a section of said part of the axial extension the outer sleeve is configured to surround the pile such that the pile is axially movable in relation to the outer sleeve.

22. A sea piling system comprising:

a percussion mechanism for driving at least one pile into an earth formation at the bottom of a sea or lake, the pile having an axial extension defining a longitudinal axis and having an outer periphery, at least a part of the axial extension of the pile being surrounded by sea or lake water; and at least one apparatus for attenuating water pressure pulses generated during sea piling when using the percussion mechanism, the apparatus having a tubular outer sleeve having an inner periphery, the outer sleeve being configured to surround the pile along at least a section of said part of the axial extension while extending in an axial direction of the pile, and a gas compressor to introduce a gas between the inner periphery of the outer sleeve and the outer periphery of the pile for providing, at least partially along said section of said part of the axial extension of the pile, one gas-filled space or a plurality of gas-filled spaces between the inner periphery of the outer sleeve and the outer periphery of the pile, the one gas-filled space or the plurality of gas-filled spaces being in direct contact with the inner periphery of the outer sleeve and the outer periphery of the pile.

* * * * *